US007894745B2

(12) United States Patent
Tsudoh et al.

(10) Patent No.: US 7,894,745 B2
(45) Date of Patent: Feb. 22, 2011

(54) HOLDING MEMBER AND UNIT USING THE HOLDING MEMBER

(75) Inventors: Emiko Tsudoh, Sagamihara (JP); Yasuhiro Matsuo, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 466 days.

(21) Appl. No.: 12/149,643

(22) Filed: May 6, 2008

(65) Prior Publication Data

US 2008/0304889 A1 Dec. 11, 2008

(30) Foreign Application Priority Data

Jun. 6, 2007 (JP) ..... 2007-150886

(51) Int. Cl.
*G03G 15/00* (2006.01)

(52) U.S. Cl. ..... 399/107

(58) Field of Classification Search ..... 399/107–100, 399/411

See application file for complete search history.

(56) References Cited

U.S. PATENT DOCUMENTS 6,665,507 B1 * 12/2003 Hooper, III et al. ..... 399/110
2005/0214022 A1 * 9/2005 Umeyama et al. ..... 399/107

FOREIGN PATENT DOCUMENTS

JP 2001-201914 7/2001
JP 2006-171031 6/2006

* cited by examiner

*Primary Examiner*—David M Gray
*Assistant Examiner*—Rodney Bonnette
(74) *Attorney, Agent, or Firm*—Harness, Dickey & Pierce, P.L.C.

(57) ABSTRACT

A holding member is provided in a gap between a plurality of elements of a unit in a non-usage state to maintain a relative position between the plurality of elements, and is removed from the gap to put the unit into a usage state. The holding member includes an attaching portion, a filament, a panel, and a block. The attaching portion is inserted in the gap between the plurality of elements. The attaching portion includes a first parallel portion, a second parallel portion, and a connecting portion to connect one end of the first parallel portion with one end of the second parallel portion. One end of the filament is attached to the attaching portion. The panel is attached to another end of the filament. The block connects another end of the first parallel portion with another end of the second parallel portion.

5 Claims, 3 Drawing Sheets

HOLDING MEMBER AND UNIT USING THE HOLDING MEMBER

PRIORITY STATEMENT

The present patent application claims priority from Japanese Patent Application No. 2007-150886 filed on Jun. 6, 2007 in the Japan Patent Office, the entire contents of which are hereby incorporated herein by reference.

BACKGROUND OF THE INVENTION

1. Field of the Invention

Example embodiments generally relate to a holding member and a unit using the holding member, for example, for holding elements included in the unit to maintain the relative positions of the elements.

2. Description of the Related Art

A related-art image forming apparatus, such as a copier, a printer, a facsimile machine, or a multifunction printer having at least one of copying, printing, scanning, and facsimile functions, forms a toner image on a recording medium (e.g., a recording sheet). Thus, for example, a charging roller uniformly charges a surface of a photoconductor. An optical writer emits a light beam onto the charged surface of the photoconductor according to image data to form an electrostatic latent image on the photoconductor. A development device develops the electrostatic latent image with toner to form a toner image. The toner image is then transferred from the photoconductor onto a recording sheet. Finally, a fixing device applies heat and pressure to the recording sheet bearing the toner image to fix the toner image on the recording sheet, thus forming an image on the recording sheet.

Such image forming apparatus may include a photoconductor unit 120 including a photoconductor 122 and a charging roller 121, as illustrated in FIG. 1. Before being used in the image forming apparatus, the photoconductor unit 120 is shipped from a plant in a state in which the photoconductor unit 120 is either contained in a packing container 130 or installed in the image forming apparatus. During shipment, an attaching portion 110 of a holding member 100 is inserted into a gap 123 between the charging roller 121 and the photoconductor 122 to maintain the gap 123 between the charging roller 121 and the photoconductor 122 and keep the charging roller 121 and the photoconductor 122 separate, so that they do not come into contact and damage each other during shipment. Thus, the holding member 100 prevents change in a relative position between the charging roller 121 and the photoconductor 122 in a non-usage state in which the photoconductor unit 120 is not used.

When the packing container 130 is opened to form an opening 130A or when a cover of the image forming apparatus is opened initially, the attaching portion 110 of the holding member 100 inserted in the gap 123 between the charging roller 121 and the photoconductor 122 is pulled in a direction indicated by arrow A, thus shifting the photoconductor unit 120 from the non-usage state described above to a usage state in which the charging roller 121 contacts the photoconductor 122.

Typically, as illustrated in FIG. 2, a panel 101 formed of a sheet easily distinguishable from other elements or units contains instructions concerning handling of the holding member 100 and warnings concerning use of the photoconductor unit 120. A filament 102 connects the panel 101 with the attaching portion 110.

The shape of the attaching portion 110 varies depending on shapes of the elements between which the attaching portion 110 is inserted. For example, when the holding member 100 is used in a development device using non-magnetic one-component toner in which a flexible elastic member causes a doctor roller to contact a development roller, the attaching portion 110 of the holding member 100 is inserted into a gap between the doctor roller and a case to secure the gap so as to prevent the doctor roller from moving during shipment.

FIG. 3 is a side view of a holding member 100A used in such development device. The holding member 100A includes an attaching portion 110S including a spacer 110A and a U-shape portion 110B. In the U-shape portion 110B, parallel portions 110C are provided parallel to each other. An elastic connecting portion 110D connects an end of one of the pair of parallel portions 110C with an end of another one of the pair of parallel portions 110C. The attaching portion 110S is inserted into the gap between the doctor roller and the case in the development device to secure the gap therebetween. When the holding member 100A is pulled in a direction indicated by arrow B1, the attaching portion 110S is removed from the development device, readying the development device for use.

The holding member 100 (depicted in FIG. 2) or 100A is manually manufactured by winding the filament 102 (e.g., a wire) attached to the panel 101 and the attaching portion 110 (depicted in FIG. 2) or 110S, lengthening manufacturing time. Further, after the holding member 100 or 100A is removed from the development device, the panel 101, the filament 102, and the attaching portion 110 or 110S are made of different materials and therefore need to be separated from each other for disposal, resulting in increased workload and costs.

Moreover, when a bag or a box contains a plurality of holding members 100A and the holding members 100A are picked up from the bag or the box one by one, a picked-up holding member 100A may be entangled with other holding member 10A. For example, the filament 102 of one holding member 100A may enter a slit formed by the U-shape portion 110B of the attaching portion 110S of another holding member 100A, as illustrated in FIG. 4. Accordingly, the filament 102 may cause the panel 101 or the attaching portion 110S, to which the filament 102 is attached, to enter the attaching portion 110S of another holding member 100A, necessitating time and effort to disentangle the entangled holding members 100A from each other.

Obviously, such increased workload and costs for disentangling the holding members 100A is undesirable, and accordingly, there is a need for a technology to prevent entanglement of the holding members 100A.

SUMMARY

At least one embodiment may provide a holding member that is provided in a gap between a plurality of elements of a unit in a non-usage state to maintain a relative position between the plurality of elements, and is removed from the gap to put the unit into a usage state. The holding member includes an attaching portion, a filament, a panel, and a block. The attaching portion is formed in a U-like shape and is inserted in the gap between the plurality of elements. The attaching portion includes a first parallel portion, a second parallel portion provided parallel to the first parallel portion, and a connecting portion to connect one end of the first parallel portion with one end of the second parallel portion. One end of the filament is attached to the attaching portion. The panel is formed in a flat plate shape and is attached to another end of the filament. The block connects another end of the first parallel portion with another end of the second parallel portion.

At least one embodiment may provide a unit that includes a plurality of elements to form a gap therebetween to maintain a relative position therebetween in a non-usage state in which a holding member is provided in the gap. The holding member is removed from the gap to put the unit into a usage state. The holding member includes an attaching portion, a filament, a panel, and a block. The attaching portion is formed in a U-like shape and is inserted in the gap between the plurality of elements. The attaching portion includes a first parallel portion, a second parallel portion provided parallel to the first parallel portion, and a connecting portion to connect one end of the first parallel portion with one end of the second parallel portion. One end of the filament is attached to the attaching portion. The panel is formed in a flat plate shape and is attached to another end of the filament. The block connects another end of the first parallel portion with another end of the second parallel portion.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
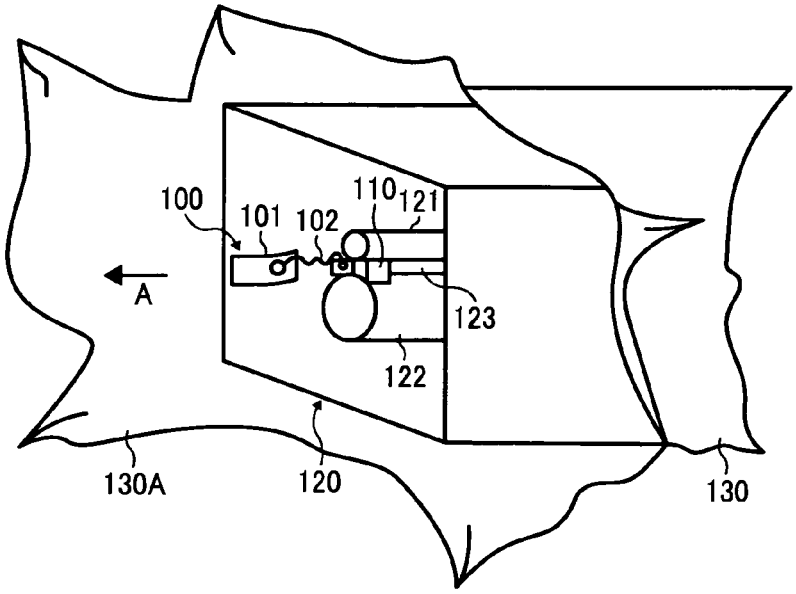
FIG. 1 RELATED ART
FIG. 1 is a perspective view of a related-art photoconductor unit in which a related-art holding member is used.
Figure 2:
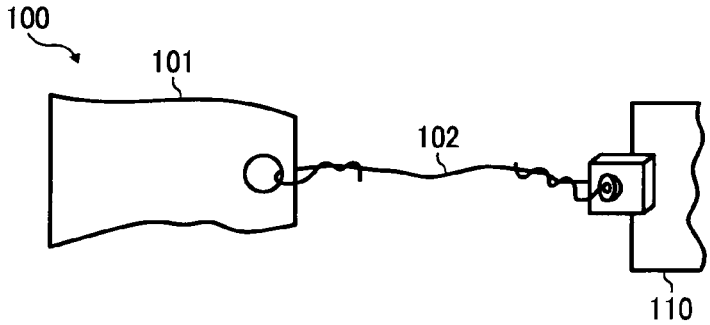
FIG. 2 RELATED ART
FIG. 2 is a side view of the related-art holding member shown in FIG. 1.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a" "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 5:
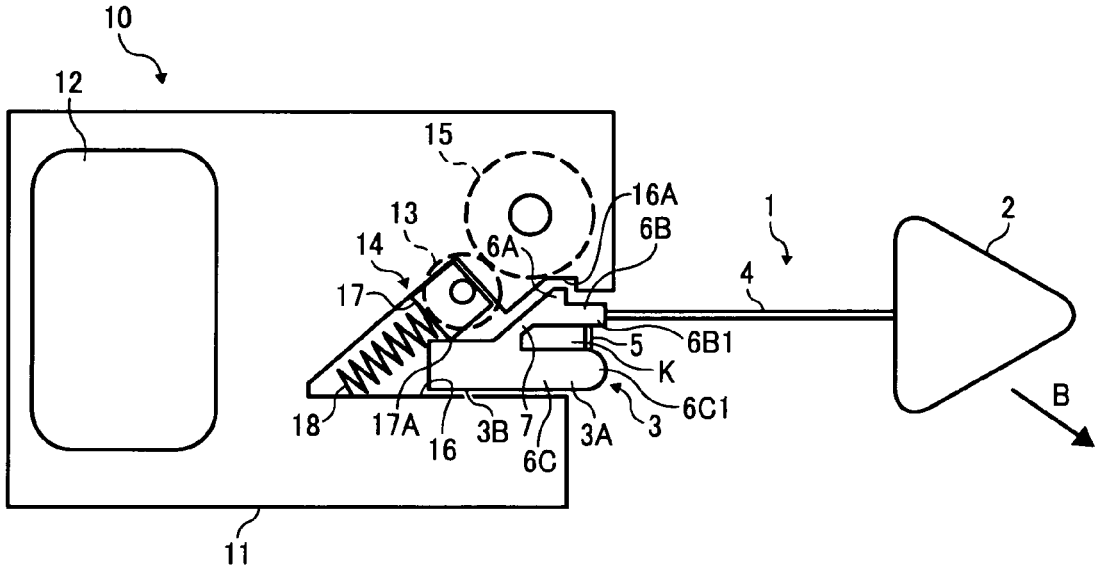
FIG. 5 is a sectional view of a development device and a holding member according to an example embodiment.
Figure 6:
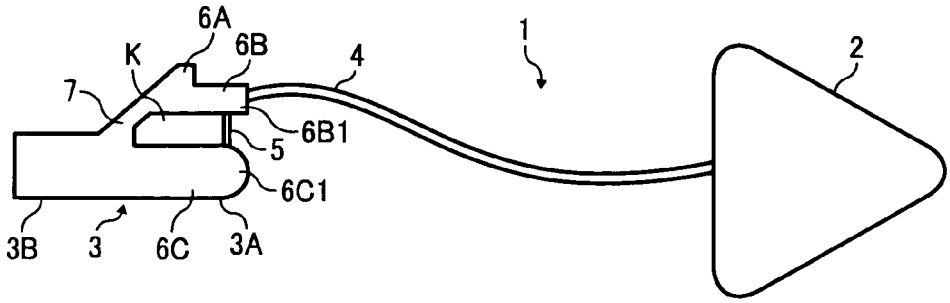
FIG. 6 is a side view (according to an example embodiment) of the holding member shown in FIG. 5.
Figure 7:
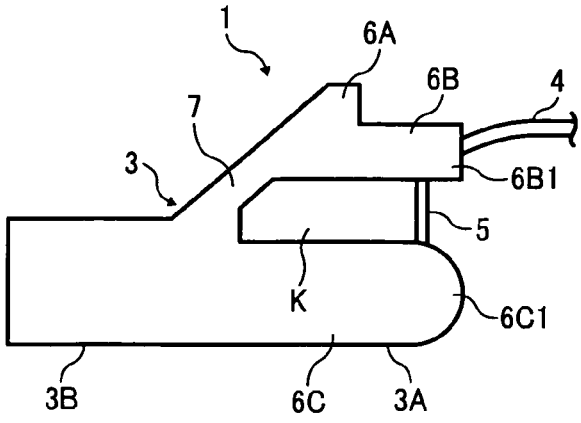
FIG. 7 is a side view (according to an example embodiment) of an attaching portion of the holding member shown in FIG. 6.

Referring now to the drawings, wherein like reference numerals designate identical or corresponding parts throughout the several views, particularly to FIGS. 5 to 7, a development device 10 and a holding member 1 according to an example embodiment are explained.

FIG. 5 is a sectional side view of the development device 10 and the holding member 1. FIG. 6 is a side view of the holding member 1. FIG. 7 is a partially enlarged side view of the holding member 1. As illustrated in FIG. 5, the development device 10 includes a case 11, a toner cartridge 12, a doctor roller 13, a roller support 14, and/or a development roller 15. The case 11 includes a cut portion 16. The cut portion 16 includes a concave portion 16A. The roller support 14 includes a support member 17 and/or a spring 18. The holding member 1 includes a panel 2, an attaching portion 3, a filament 4, and/or a block 5. The attaching portion 3 includes a U-shape portion 3A and/or a spacer 3B. The U-shape portion 3A includes parallel portions 6B and 6C, a connecting portion 7, and/or an engaging portion 6A. The parallel portion 6B includes an end 6B1. The parallel portion 6C includes an end 6C1.

As illustrated in FIG. 5, the development device 10 is formed in a unit and uses non-magnetic one-component toner. The development device 10 is installed in an image forming apparatus (not shown), such as a copier, a facsimile machine, a printer, or a multifunction printer having at least one of copying, printing, scanning, and facsimile functions.

The case 11 includes an insulating synthetic resin and has a box-like shape. A part of the case 11 is cut to form the cut portion 16 to and from which the attaching portion 3 of the holding member 1 is attachable and detachable. The cut portion 16 penetrates the case 11 and is provided near the development roller 15 and the doctor roller 13. The concave portion 16A is provided on an inner surface of the cut portion 16 and engages with the engaging portion 6A of the attaching portion 3.

The toner cartridge 12 is attachable to and detachable from the case 11 and contains non-magnetic one-component toner to be supplied to an outer circumferential surface of the development roller 15.

The doctor roller 13 has a cylindrical shape. The roller support 14 supports the doctor roller 13 in a manner that the doctor roller 13 rotates around an axis of the doctor roller 13 and contacts and separates from the development roller 15. A force presses the doctor roller 13 toward the development roller 15 so that the doctor roller 13 contacts the outer circumferential surface of the development roller 15. The doctor roller 13 regulates an amount of toner particles adhered to the outer circumferential surface of the development roller 15 and charges the toner particles.

The roller support 14 includes the support member 17 and the spring 18 serving as a force applier. The support member 17 rotatably supports the axis of the doctor roller 13 at an internal diameter and is provided inside the cut portion 16. The support member 17 is slidable in a diametrical direction of the development roller 15. For example, the support member 17 moves in the diametrical direction of the development roller 15 to cause the doctor roller 13 to contact and separate from the development roller 15.

The spring 18 is provided between the inner surface of the cut portion 16 and the support member 17, and presses the support member 17 and the doctor roller 13 toward the development roller 15. Thus, the spring 18 causes an outer circumferential surface of the doctor roller 13 to contact the outer circumferential surface of the development roller 15.

The development roller 15 is rotatably provided in the case 11. The development roller 15 opposes a photoconductor (not shown) included in the image forming apparatus in a state that the development roller 15 contacts the photoconductor or is positioned near the photoconductor. The toner particles supplied by the toner cartridge 12 are adhered to the outer circumferential surface of the development roller 15. The toner particles are charged by the doctor roller 13 and applied to the photoconductor.

The holding member 1 is provided between the case 11 and the doctor roller 13.

As illustrated in FIG. 6, the panel 2, the attaching portion 3, the filament 4, and the block 5 are integrally provided. The panel 2 has a thin, flat plate shape. In a plane view, the panel 2 has a triangular shape in which each of three angles has an arc shape. When the holding member 1 is attached to the development device 10 (depicted in FIG. 5), the panel 2 is easily distinguished from elements included in the development device 10, such as the development roller 15 (depicted in FIG. 5). Characters and marks showing how to handle the holding member 1 and cautions to be exercised by a user before using the development device 10 are formed or printed on a surface of the panel 2.

As illustrated in FIG. 7, the attaching portion 3 has a thick, flat plate shape. The U-shape portion 3A and the spacer 3B are integrally provided. The U-shape portion 3A has a U-like shape and includes the parallel portions 6B and 6C and the connecting portion 7. The parallel portions 6B and 6C are provided parallel to each other to form a pair of parallel bars. The connecting portion 7 connects one end of the parallel portion 6B with one end of the parallel portion 6C. The engaging portion 6A is provided on top of the parallel portion 6B in a direction separating from the parallel portion 6C. For example, the engaging portion 6A protrudes from the parallel portion 6B to form a convex shape. The engaging portion 6A enters the concave portion 16A of the case 11 (depicted in FIG. 5) and engages with the case 11. The U-shape portion 3A has a U-like shape in a side view. Therefore, the connecting portion 7 may be elastically deformed so that another end (e.g., the end 6B1) of the parallel portion 6B contacts and separates from another end (e.g., the end 6C1) of the parallel portion 6C.

The spacer 3B extends from one end of the parallel portion 6C in a direction separating from the parallel portion 6C and parallel to the parallel portion 6C. When the attaching portion 3 is inserted in the cut portion 16 (depicted in FIG. 5), the spacer 3B overlaps a point of an angle 17A (depicted in FIG. 5), that is, a protruding angle formed by the support member 17 (depicted in FIG. 5) in the cut portion 16.

As illustrated in FIG. 6, the filament 4 has a string shape. One end of the filament 4 is attached to the end 6B1 of the parallel portion 6B of the attaching portion 3. Another end of the filament 4 is attached to the panel 2.

As illustrated in FIG. 7, the block 5 has a bar shape. Both ends of the block 5 contact the ends 6B1 and 6C1 of the parallel portions 6B and 6C, respectively, to connect the end 6B1 with the end 6C1. A longitudinal direction of the block 5 intersects with a longitudinal direction of the pair of the parallel portions 6B and 6C. For example, the longitudinal direction of the block 5 is perpendicular to the longitudinal direction of the pair of the parallel portions 6B and 6C.

As illustrated in FIG. 6, an inner surface of the U-shape portion 3A and the block 5 enclose a space K. The panel 2 is larger than the space K. Thus, the panel 2 of one holding member 1 may not enter the space K (e.g., inside of the U-shape portion 3A) of another holding member 1.

The holding member 1 includes plastic which may be elongated. The panel 2, the attaching portion 3, the filament 4, and the block 5 are integrally molded to form the holding member 1. Namely, the panel 2, the attaching portion 3, the filament 4, and the block 5 are formed of an identical material. The block 5 may be stretched or bent because the block 5 has a bar shape. The holding member 1 may preferably include polyamide. The holding member 1 including polyamide may have an increased strength against a pulling force applied to the filament 4, resulting in an improved durability of the holding member 1.

According to this example embodiment, the block 5 has a cylindrical shape having an outer diameter in a range of from about 0.3 mm to about 0.5 mm. The space K formed by the block 5 and the inner surface of the U-shape portion 3A has a size of about 7 mm×about 3 mm. The panel 2 has a triangular plate shape, about 30 mm on a side. Thus, while the U-shape portion 3A maintains elasticity, the holing member 1 may prevent the panel 2 of another holding member 1 from entering the space K.

Referring to FIG. 5, the following describes how the holding member 1 is attached to the development device 10. The holding member 1 is inserted into the cut portion 16 of the development device 10 in a manner that the spacer 3B and the connecting portion 7 enter a gap (e.g., a space) between the case 11 and the doctor roller 13. Accordingly, the engaging portion 6A contacts the inner surface of the cut portion 16, and the connecting portion 7 is elastically deformed in a direction in which the end 6B1 moves closer to the end 6C1. The flexible block 5 does not prevent deformation of the connecting portion 7. Namely, the flexible block 5 does not prevent the attaching portion 3 from being attached to the cut portion 16 of the case 11 of the development device 10. The spacer 3B overlaps the point of the angle 17A of the support member 17. The engaging portion 6A engages with the concave portion 16A provided on the inner surface of the cut portion 16. Thus, the holding member 1 is attached to the case 11 of the development device 10.

Since the holding member 1 overlaps the point of the angle 17A of the support member 17 and the angle 17A intersects a surface of the spacer 3B, the holding member 1 fixes the support member 17 to the case 11. Accordingly, the doctor roller 13 supported by the support member 17 is fixed to the case 11. Namely, when the holding member 1 is inserted into the gap between the doctor roller 13 and the case 11, the holding member 1 holds the doctor roller 13 at a proper position in the case 11 to maintain a relative position between the doctor roller 13 and the case 11.

When the development device 10 is packed for shipment, the holding member 1 is inserted into the gap between the case 11 and the doctor roller 13 in the cut portion 16 to fix the doctor roller 13 at a position in the case 11. Thus, the development device 10 is in a non-usage state in which the development device 10 is not activated or used. When the panel 2 and the filament 4 of the holding member 1 are pulled in a direction B, the connecting portion 7 is elastically deformed in the direction in which the end 6B1 moves closer to the end 6C1. Accordingly, the engaging portion 6A is disengaged with the concave portion 16A and moves out of the concave portion 16A. Thus, the holding member 1 is removed from the gap between the case 11 and the doctor roller 13 in the cut portion 16. As a result, the development device 10 is in a usage state in which the doctor roller 13 may contact and separate from the development roller 15.

When the development device 10 is in the non-usage state while the development device 10 is packed for shipment, for example, the holding member 1 is put in the gap between the case 11 and the doctor roller 13 to maintain the relative position between the case 11 and the doctor roller 13. When the holding member 1 is removed from the gap between the case 11 and the doctor roller 13, the development device 10 is in the usage state.

According to this example embodiment, the block 5 is provided in the space K between the ends 6B1 and 6C1 of the parallel portions 6B and 6C, respectively. Therefore, when a package or a box contains a plurality of holding members 1 and one of the plurality of holding members 1 is picked up from the package or the box, the filament 4, the attaching portion 3, or the panel 2 of other holding member 1 may not enter the space K of the attaching portion 3 of the picked-up holding member 1. Namely, the plurality of holding members 1 may not be entangled with each other. Accordingly, a complicated job for disentangling the holding members 1 entangled with each other may be reduced and the holding members 1 may be attached to the development devices 10 efficiently.

The panel 2 is larger than the space K formed by the block 5 and the inner surface of the U-shape portion 3A of the attaching portion 3. Thus, the panel 2 may not enter the space K, preventing a plurality of holding members 1 from entangling with each other. Accordingly, a complicated job for disentangling the holding members 1 entangled with each other may be reduced and the holding members 1 may be attached to the development devices 10 efficiently.

The flexible block 5 connecting the end 6B1 of the parallel portion 6B with the end 6C1 of the parallel portion 6C may not disturb bending of the attaching portion 3 needed to attach and detach the holding member 1 to and from the gap between the case 11 and the doctor roller 13 of the development device 10. Thus, the holding member 1 may be attached to the development device 10 efficiently.

The attaching portion 3, the filament 4, the panel 2, and the block 5 are formed of an identical material. Therefore, after the holding member 1 is removed from the development device 10, the holding member 1 may be recycled without separating the attaching portion 3, the filament 4, the panel 2, and the block 5 from each other.

The development device 10 is a unit in which the holding member 1 may be used. Therefore, the holding member 1 may be attached to the development device 10 without the complicated job for disentangling the holding members 1 entangled with each other. Namely, the development device 10 may be easily assembled for shipment.

Figure 8:
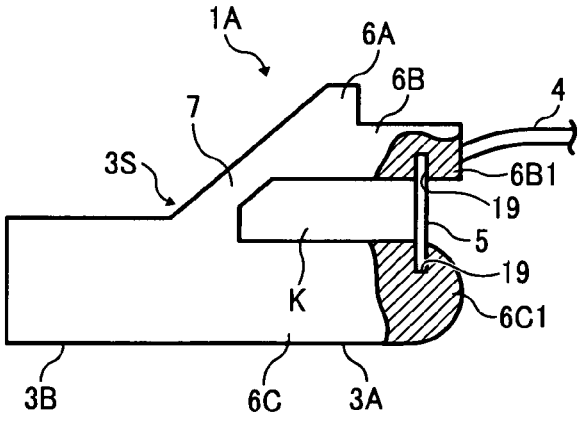
FIG. 8 is a side view of a holding member according to another example embodiment.
Figure 9:
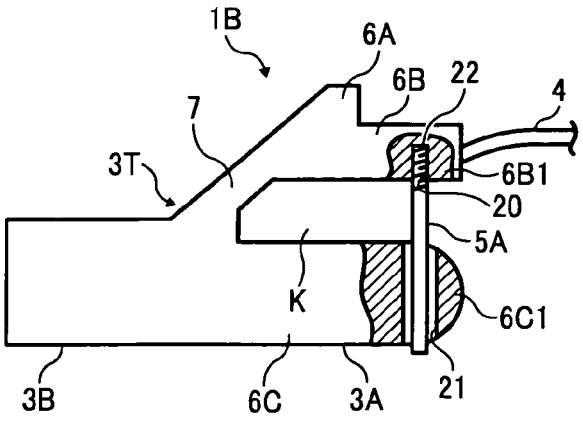
FIG. 9 is a side view of a holding member according to yet another example embodiment.

According to this example embodiment, the block 5 is integrally provided with the attaching portion 3. However, the block 5 may be separately provided from the attaching portion 3, as illustrated in FIGS. 8 and 9. FIG. 8 is a sectional view of a holding member 1A according to another example embodiment. The holding member 1A includes an attaching portion 3S. The attaching portion 3S includes concave portions 19. The other elements of the holding member 1A are common to the holding member 1 depicted in FIG. 6.

The block 5 has a cylindrical shape. The concave portions 19 are provided on inner surfaces of the ends 6B1 and 6C1 facing each other, respectively. The block 5 engages with the concave portions 19 so that the block 5 is fixed to the attaching portion 3S.

FIG. 9 is a sectional view of a holding member 1B according to yet another example embodiment. The holding member 1B includes an attaching portion 3T and/or a block 5A. The attaching portion 3T includes a screw hole 20 and/or a through hole 21. The block 5A includes a screw groove 22. The other elements of the holding member 1B are common to the holding member 1 depicted in FIG. 6.

The screw hole 20 is provided on an inner surface of an end (e.g., the end 6B1) of one of the pair of parallel portions 6B and 6C. The through hole 21 is provided in an end (e.g., the end 6C1) of another one of the pair of parallel portions 6B and 6C. The block 5A has a cylindrical shape and the screw groove 22 is formed in one end of the block 5A. The block 5A is threaded through the through hole 21 and the screw groove 22 of the block 5A is screwed in the screw hole 20. Thus, the block 5A is fixed to the attaching portion 3T.

Figure 3:
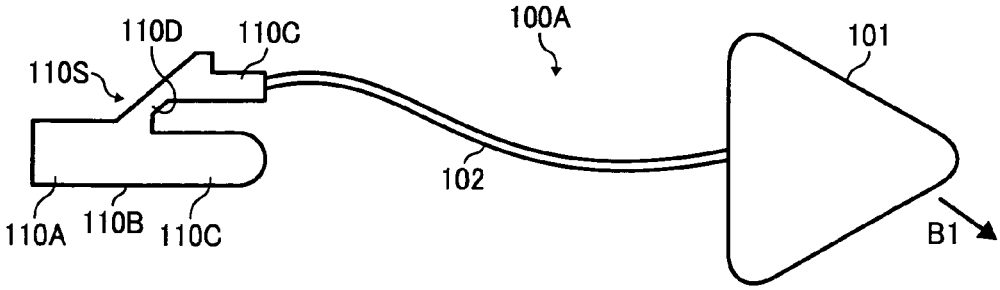
FIG. 3 RELATED ART
FIG. 3 is a side view of another related-art holding member.
Figure 4:
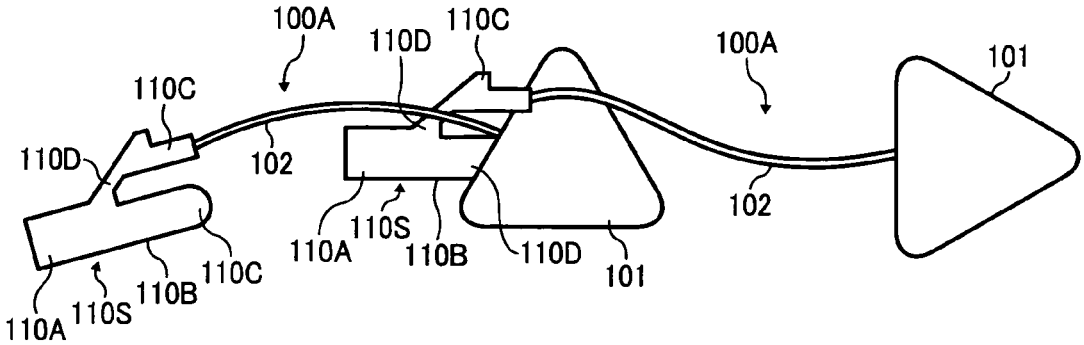
FIG. 4 RELATED ART
FIG. 4 is a side view of the related-art holding members shown in FIG. 3 entangled with each other.

The following describes an experiment performed using a holding member according to the above-described example embodiments (e.g., the holding member 1 depicted in FIG. 6, the holding member 1A depicted in FIG. 8, or the holding member 1B depicted in FIG. 9, and hereinafter referred to as the holding member 1) and a reference holding member (e.g., the holding member 100A depicted in FIG. 3) so as to verify effects provided by the holding member 1.

In the experiment, 100 pieces of the holding members 1 and 100 pieces of the holding members 100A were put in bags, respectively. The holding members 1 and 100A were picked up from the bags one by one, respectively, and how many holding members 1 and 100A were entangled with each other was counted, respectively.

When 100 pieces of the holding members 100A were picked up from the bag, 50 pieces or more of the holding members 100A were entangled with other holding member 10A. Namely, entanglement occurred every 2 picks-up. By contrast, when 100 pieces of the holding members 1 were picked up from the bag, 10 pieces or less of the holding members 1 were entangled with other holding member 1. Namely, entanglement occurred every 10 picks-up. Thus, the experiment reveals that provision of the block 5 (depicted in FIGS. 6 and 8) or the block 5A (depicted in FIG. 9) may prevent the holding members 1 from being entangled with each other.

According to the above-described example embodiments, the holding member 1 (depicted in FIG. 5), 1A (depicted in FIG. 8), or 1B (depicted in FIG. 9) is inserted into the gap between the case 11 and the doctor roller 13 (depicted in FIG. 5). However, the holding member 1, 1A, or 1B may be inserted into a gap between elements other than the case 11 and the doctor roller 13. Further, the holding member 1, 1A, or 1B may be used in various devices or units other than the development device 10 (depicted in FIG. 5).

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A holding member for being provided in a gap between a plurality of elements of a unit in a non-usage state to maintain a relative position between the plurality of elements, and being removed from the gap to put the unit into a usage state, the holding member comprising:

an attaching portion formed in a U-like shape and inserted in the gap between the plurality of elements, the attaching portion comprising:

a first parallel portion;

a second parallel portion provided parallel to the first parallel portion; and a connecting portion to connect one end of the first parallel portion with one end of the second parallel portion;

a filament one end of which is attached to the attaching portion;

a panel formed in a flat plate shape and attached to another end of the filament; and a block to connect another end of the first parallel portion with another end of the second parallel portion.

2. The holding member according to claim 1, wherein the panel is larger than a space enclosed by an inner surface of the attaching portion and the block.

3. The holding member according to claim 1, wherein the block is flexible.

4. The holding member according to claim 1, wherein the attaching portion, the filament, and the panel are made of an identical material.

5. A unit, comprising:

a plurality of elements; and a holding member, the plurality of elements to form a gap therebetween to maintain a relative position therebetween in a non-usage state in which the holding member is provided in the gap, the unit to be put into a usage state when the holding member is removed from the gap, the holding member comprising:

an attaching portion formed in a U-like shape and inserted in the gap between the plurality of elements, the attaching portion comprising:

a first parallel portion;

a second parallel portion provided parallel to the first parallel portion; and a connecting portion to connect one end of the first parallel portion with one end of the second parallel portion;

a filament one end of which is attached to the attaching portion;

a panel formed in a flat plate shape and attached to another end of the filament; and a block to connect another end of the first parallel portion with another end of the second parallel portion.

* * * * *